US007443369B2

(12) United States Patent
Takahashi et al.

(10) Patent No.: US 7,443,369 B2
(45) Date of Patent: Oct. 28, 2008

(54) LIQUID CRYSTAL DISPLAY DEVICE AND AN OPTIMUM GRADATION VOLTAGE SETTING APPARATUS THEREOF

(75) Inventors: Satoshi Takahashi, Isumi (JP); Yasuhiko Yamagishi, Mobara (JP); Nobuyuki Koganezawa, Chiba (JP)

(73) Assignees: Hitachi Displays, Ltd., Mobara-Shi (JP); Hitachi Display Devices, Ltd., Mobara-Shi (JP)

( * ) Notice: Subject to any disclaimer, the term of this patent is extended or adjusted under 35 U.S.C. 154(b) by 518 days.

(21) Appl. No.: 10/901,047

(22) Filed: Jul. 29, 2004

(65) Prior Publication Data

US 2005/0024311 A1 Feb. 3, 2005

(30) Foreign Application Priority Data

Jul. 30, 2003 (JP) ..... 2003-203483

(51) Int. Cl.
*G09G 3/36* (2006.01)

(52) U.S. Cl. ..... 345/87; 345/89

(58) Field of Classification Search ..... 345/76–77, 345/87–90, 94–100, 204, 208–214, 690
See application file for complete search history.

(56) References Cited

U.S. PATENT DOCUMENTS

| | | | | |
|---|---|---|---|---|
| 6,727,880 | B2 * | 4/2004 | Lee | 345/98 |
| 7,113,156 | B2 * | 9/2006 | Hashimoto | 345/77 |
| 7,119,782 | B2 * | 10/2006 | Sunohara et al. | 345/100 |
| 2003/0231160 | A1 * | 12/2003 | Yoshihara et al. | 345/102 |

* cited by examiner

*Primary Examiner*—Richard Hjerpe
*Assistant Examiner*—Mansour M Said
(74) *Attorney, Agent, or Firm*—Antonelli, Terry, Stout & Kraus, LLP.

(57) ABSTRACT

A liquid crystal display device which favorably displays an image by eliminating irregularities of the γ characteristic for every manufactured liquid crystal panel. In the liquid crystal display device, when a power source is supplied thereto, a display control circuit installed therein reads out gradation voltage data corresponding to the liquid crystal panel stored in a ROM connected to the display control circuit and sets gradation voltages in a gradation voltage setting circuit installed therein. Further, upon receiving external control signals, the display control circuit sets gradation voltages in the gradation voltage setting circuit. When the set gradation voltages are inputted to a source driver section of the liquid crystal display device, the liquid crystal panel is driven and images are displayed thereby.

6 Claims, 7 Drawing Sheets

Block Diagram of the Conventional Liquid Crystal Display Device

Conventional Circuit for Generating Gradation Voltages

LIQUID CRYSTAL DISPLAY DEVICE AND AN OPTIMUM GRADATION VOLTAGE SETTING APPARATUS THEREOF

The present application claims priority from Japanese application JP 2003-203483, filed on Jul. 30, 2003, the content of which is hereby incorporated by reference into this application.

BACKGROUND OF THE INVENTION

The present invention relates to a liquid crystal display device and to an optimum gradation voltage setting apparatus, which determines γ characteristics. The present invention is also applicable to display devices having optical γ characteristics in general, such as PDP and EL display devices, besides the above-mentioned liquid crystal display device.

FIG. 8 is a block diagram which schematically shows one examples of the circuit constitution of a conventional liquid crystal display device (liquid crystal display module) which has been developed by the inventors of the present invention. The liquid crystal display device is constituted of a liquid crystal panel 1, a gate driver section 2, a source driver section 3, a display control circuit 4, a power source circuit 5, a ladder resistor circuit 8 and a driver circuit 9, wherein the liquid crystal display device is operated when digital signals, such as display data signals, synchronizing signals and the like, are inputted as input signals, and input power is supplied to the power source circuit 5.

The inputted digital input signals are temporarily subjected to a timing adjustment using synchronizing signals and the alternation of the display data signals in the display control circuit 4, such that a direct current is not applied to the liquid crystal panel, and these synchronizing signals and the display data signals are transmitted to the gate driver section 2 and the source driver section 3.

Further, the gradation voltage from the driver circuit 9, to which a voltage divided by the ladder resistor circuit 8 is inputted, is transmitted to the source driver section 3, while the source driver section 3 selects the gradation voltage corresponding to a level of the display data signal and supplies the gradation voltage to the liquid crystal panel 1, whereby the display data signals are displayed on a screen of the liquid crystal panel 1.

Here, the source driver section 3 further divides the gradation voltages, thus outputting 64 to 256 kinds of voltages in total, whereby a fine gradation display can be produced.

FIG. 9 is a diagram of a conventional circuit for generating gradation voltages, which shows an example of the ladder resistor circuit 8 and the drive circuit 9 of FIG. 8. In the drawing, the ladder resistor circuit 8 divides the potential difference between the reference voltage 1 and the reference voltage 2 using resistors 10, determines voltages in the form of required gradation voltages 1 to n, and supplies these voltages to the source driver section 3 through buffers 11 in the drive circuit 9.

FIG. 10 is a graph which shows the relationship between the gradation voltage and the brightness. Although the relationship usually exhibits the standard brightness characteristic 12, due to various factors, such as irregularities in the manufacture of the panels, a temperature change or the like, the brightness characteristic 12 may be shifted in the up-and-down direction with respect to the brightness and shifted in the left-and-right direction with respect to the gradation voltage, thus exhibiting one of the brightness characteristics 13. With respect to the gradation voltage m, since the brightness Bm corresponding to the gradation voltage is shifted in the up-and-down direction by ±ΔB, for example, the γ characteristic, which represents the relationship between the input signal and the brightness, as shown in FIG. 11, is shifted, thus causing the quality of the image display to be deteriorated.

That is, in an AS-TFT module for TV use or one capable of coping with an animated picture, 10 to 12 kinds of gradation voltages are supplied to the source driver section 3, such that the optical γ characteristic becomes 2.2. However, due to irregularities in manufacturing the panels, this γ characteristic is also changed, thus causing the display quality to deteriorate.

Here, as examples of a liquid crystal display device which performs γ correction, reference Is made to the following Patent Documents 1, 2.

[Patent Document 1]

Japanese Patent Application (Laid-open) Hei6(1994)-195046 In this Patent Document 1, the following technique is used to perform γ correction in a liquid crystal display device using a ROM.

By inputting the digital image data to an address of the ROM, digital image data having a corrected γ characteristic is obtained from the output of the addressed ROM.

However, the provision of a ROM which has addresses capable of coping with all levels of the digital image data calls for a large capacity ROM. Accordingly, levels of digital image data corresponding to portions which have similar γ characteristics are divided into regions. For example, when the region where the γ characteristic is low is similar to the region where the γ characteristic is high, the respective levels of the low-level region are used as addresses of the ROM and the respective levels of the high-level region are outputted by inverting the output of the ROM at respective levels of the low-level region, thus decreasing the capacity of the ROM.

[Patent Document 2]

Japanese Patent Application (Laid-open) Hei5(1993)-64037

This Patent Document 2 describes the following technique to perform γ correction of a liquid crystal display device automatically using an all-purpose microcomputer.

In an all-purpose microcomputer, γ correction data is stored in a γ correction memory in which image data is inputted, and image data, which has received γ correction and is outputted from the memory, is displayed on the liquid crystal display device. The brightness of the displayed image is measured by a brightness photometer, and the all-purpose microcomputer determines whether or not the measured brightness is a brightness corresponding to the inputted image data, and it stores the γ correction data in the memory for γ correction, such that a corresponding luminance is obtained.

SUMMARY OF THE INVENTION

In the previous technology, particularly with respect to the liquid crystal display device shown in FIG. 8, since the gradation voltages 1-n are fixedly set based on values of reference voltages 1, 2 and resistors 10, as shown in FIG. 9, the irregularities introduced in manufacture cannot be corrected for each panel.

Further, the ROM or the memory for γ correction as described in the Patent Documents 1, 2 is used for allowing the inputting of image data to the addresses of the ROM or the memory and the outputting of γ-corrected image data. That is, neither the ROM nor the memory is used for outputting the set gradation voltages.

According to the present invention, in order to set optimum gradation voltages which exhibit a fixed γ characteristic for each manufactured panel, for example, a digital/analogue converter is used for setting the optimum gradation voltages. Due to such a constitution, it is possible to set gradation voltages which respectively correspond to the manufactured panels, whereby the respective manufactured panels will exhibit a fixed γ characteristic.

Further, by setting the gradation voltages from the outside, it is possible to set arbitrary gradation voltages, and, hence, it is possible to obtain an arbitrary γ characteristic. Accordingly, with respect to an image which loses the resolution feeling of a dark portion when the whole image exhibits a low brightness, and which also loses the resolution feeling of a bright portion when the whole image is bright, it is possible to obtain a favorable image quality having a desired resolution feeling by setting an arbitrary γ characteristic at the dark portion and at the bright portion.

DETAILED DESCRIPTION

Figure 1:
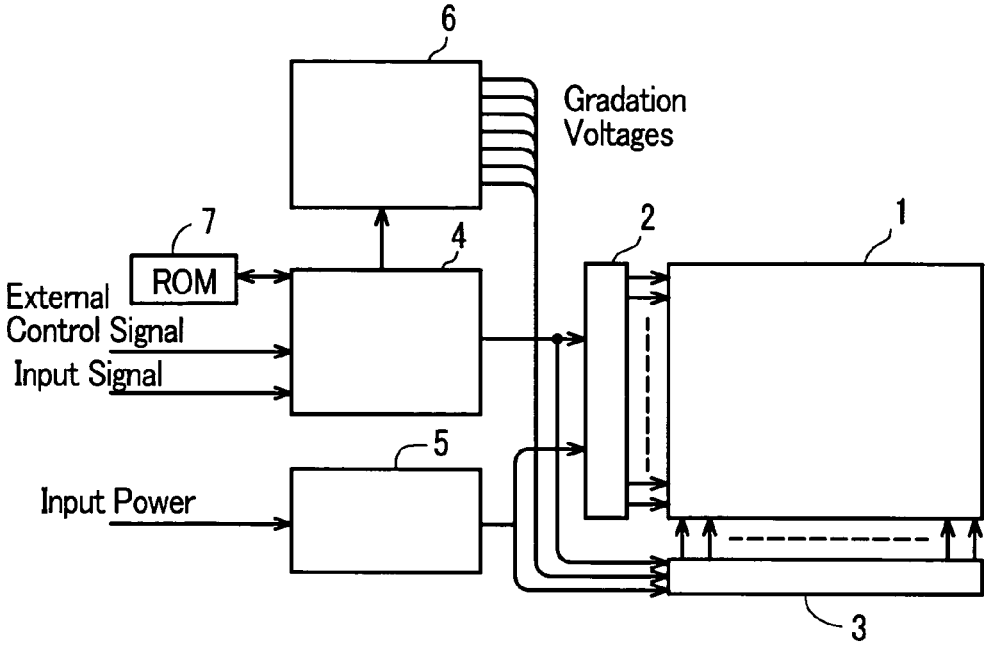
FIG. 1 is a block diagram of a liquid crystal display device representing one embodiment of the present invention.
Figure 8:
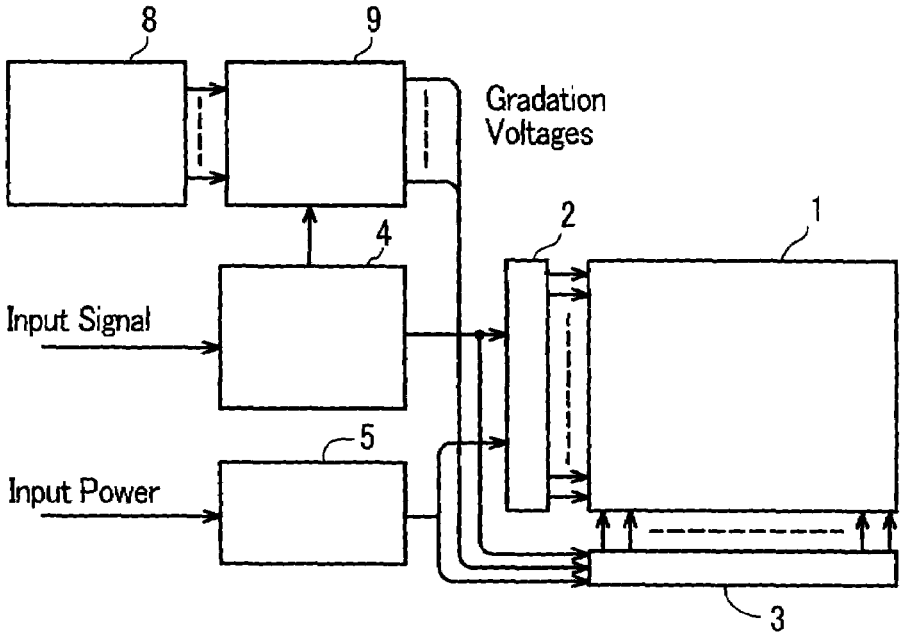
FIG. 8 is a block diagram of a conventional liquid crystal display device.
Figure 9:
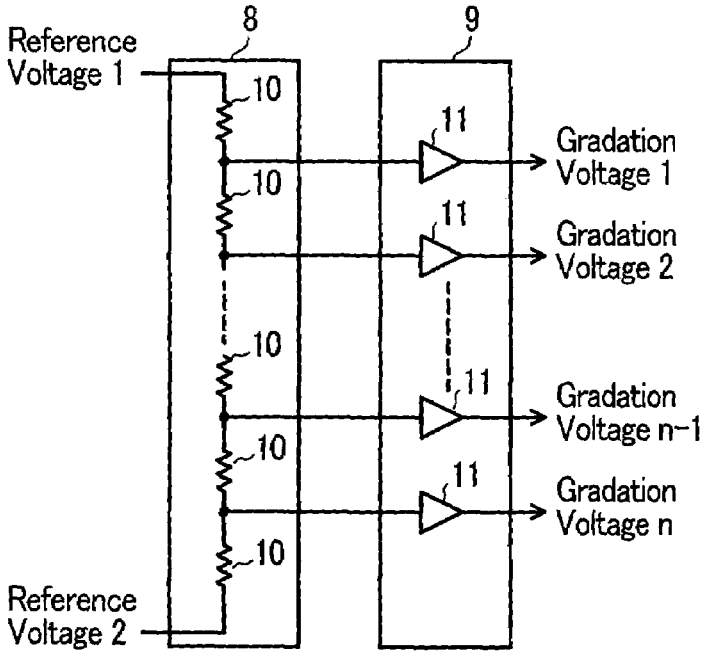
FIG. 9 is a circuit diagram of a circuit for generating a conventional gradation voltage.

FIG. 1 is a block diagram of a liquid crystal display device according to one embodiment of the present invention. The features which make the liquid crystal display device of this embodiment different from the conventional liquid crystal display device shown in FIG. 8 lies in the fact that the ladder resistor circuit 8 and the driver circuit 9 are eliminated; and, in place of these circuits, a gradation voltage setting circuit 6 and a ROM (Read Only Memory) 7 are provided, and external control signals can be inputted to a display control circuit 4 from the outside.

In this liquid crystal display device, at the time of supplying power to the liquid crystal display device, a display control circuit 4, which constitutes display control means, reads out gradation voltage value data corresponding to a liquid crystal panel 1 from the ROM 7, which constitutes storage means, and sets gradation voltages in the gradation voltage setting circuit 6, which constitutes gradation voltage setting means. Further, during regular operation, the gradation voltage also can be set based on external control signals from the outside.

Figure 2:
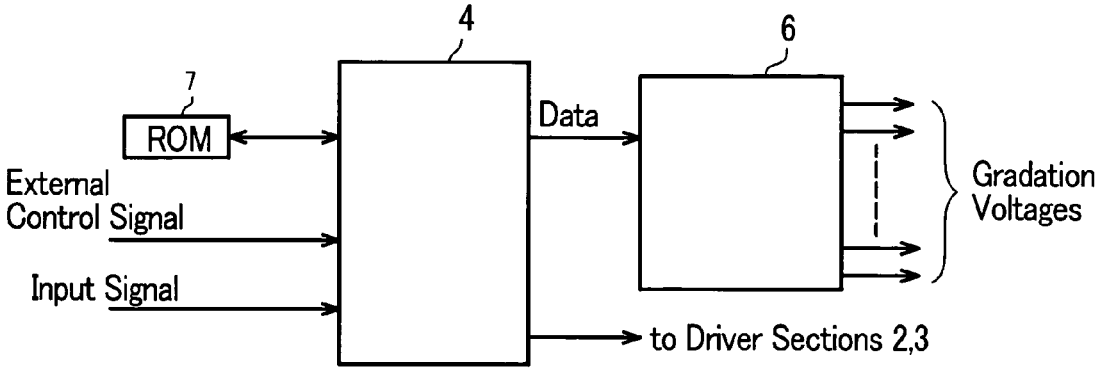
FIG. 2 is a block diagram showing a state in which the display control circuit 4 of FIG. 1 transmits gradation voltage value data stored in a ROM 7 to a gradation voltage setting circuit 6.

FIG. 2 is a view showing a state in which the display control circuit 4 of the liquid crystal display device according to one embodiment of the present invention, as shown in FIG. 1, transmits gradation voltage value data stored in the ROM 7 to the gradation voltage setting circuit 6. Here, external control signals are inputted to the display control circuit 4. Further, the external control signals are in the form of digital signals for serial communication, and, hence, this feature is effective in view of the fact that, in contrast to parallel communication, the number of pins, such as connectors, can be reduced.

Using the external control signals, the display control circuit 4 writes the gradation voltage value data in the ROM 7. Further, using the external control signals, the display control circuit 4 directly sets arbitrary gradation voltages in the gradation voltage setting circuit 6.

The gradation voltage value data corresponding to the manufactured panel is stored in the ROM 7. The gradation voltage setting circuit 6 sets the gradation voltage corresponding to the gradation voltage value data from the outside or the gradation voltage value data from the ROM which is transmitted through the display control circuit 4.

Figure 3:
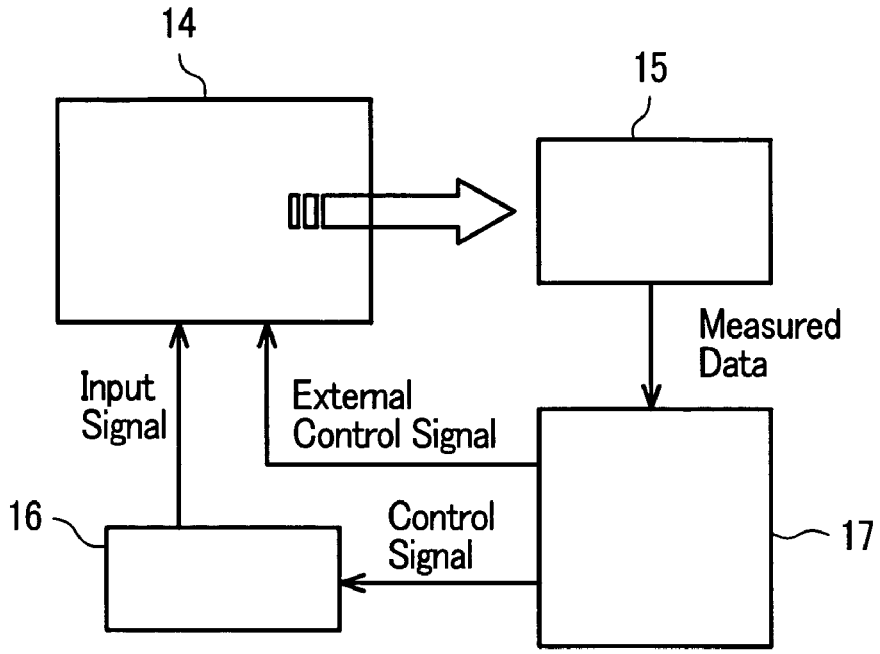
FIG. 3 is a block diagram of an optimum gradation voltage setting apparatus which measures the brightness corresponding to the gradation voltage of a liquid crystal module 14 which constitutes the liquid crystal display device forming one embodiment of the present invention and which stores the gradation voltage value data in the ROM 7.

FIG. 3 is a block diagram of an optimum gradation voltage setting apparatus, which measures the brightness corresponding to the gradation voltage of the liquid crystal module 14 that constitutes a liquid crystal display device forming one embodiment of the present invention, and which stores the gradation voltage value data in the ROM 7. For measuring the brightness corresponding to the optimum gradation voltage for every manufactured panel, the optimum gradation voltage setting apparatus includes a liquid crystal module 14, a reference signal generator 16 which drives the liquid crystal module 14, a brightness photometer 15 which measures the brightness of the liquid crystal module 14, and a personal computer (hereinafter referred to as "PC") 17 which receives the measured data from the brightness photometer 15 and outputs control signals to the reference signal generator 16 and the external control signals to the liquid crystal module 14.

The PC 17 controls the reference signal generator 16 using the control signals, supplies the reference input signals corresponding to white and black from the reference signal generator 16 to the liquid crystal module 14 to cause the liquid crystal module 14 display black and white sequentially, causes the brightness photometer 15 to measure the brightness of black and white at a point of time, and reads the measured data on white and black.

Figure 10:
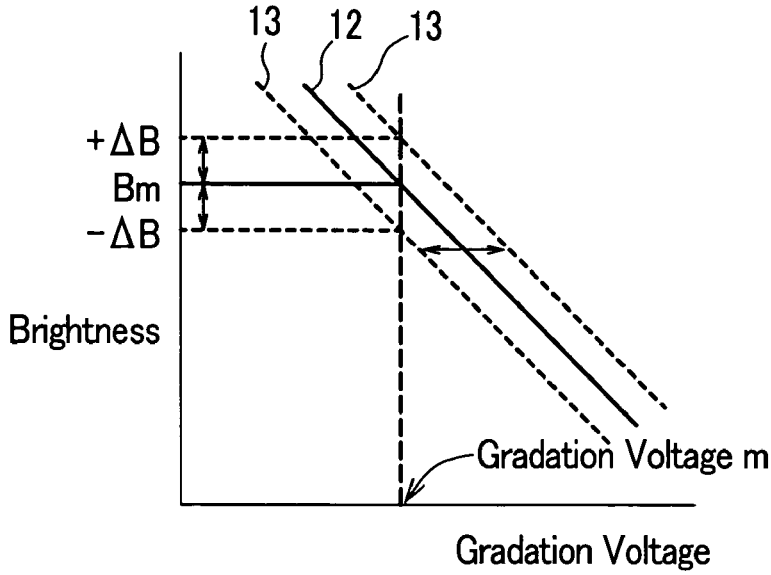
FIG. 10 is a graph showing the relationship between the gradation voltage and the brightness.
Figure 11:
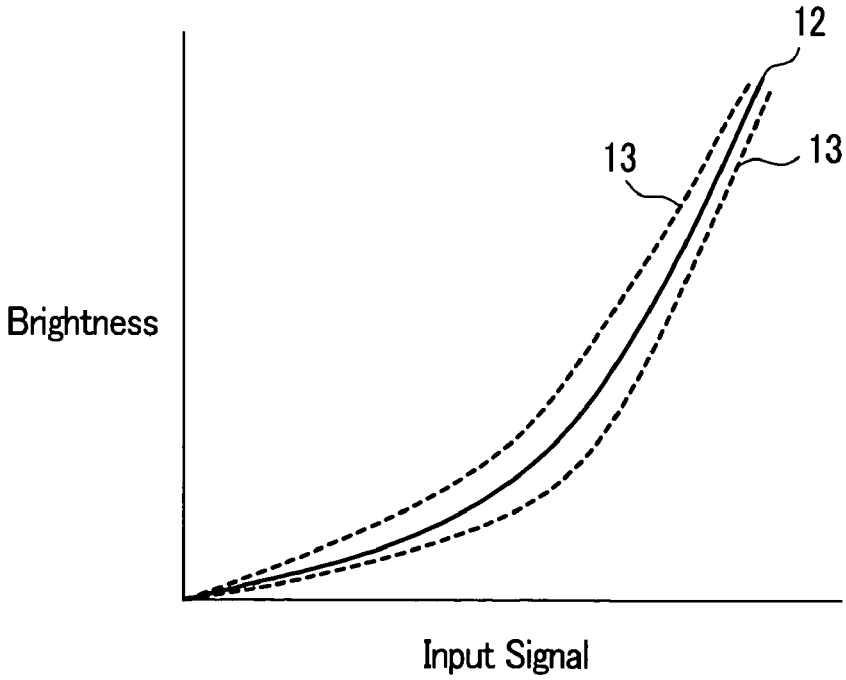
FIG. 11 is a graph showing the relationship between the input signal and the brightness.

Based on the gradation voltage value corresponding to the black and white measured data, the PC 17 controls the reference signal generator 16 using the control signals and causes the liquid crystal display module 14 to sequentially display a half tone, which is generated by the reference signal generator 16. The brightness photometer 15 then reads out the brightness of the half tone sequentially. Using the measured data of the half tone, the PC 17 determines whether or not the half tone is the optimum gradation voltage value for the liquid crystal display module 14. That is, as shown in FIG. 10, it is judged whether or not the relationship between the gradation voltage and the brightness corresponds to the optimum brightness characteristic 12.

When the relationship is optimum, using the external control signals, the PC 17 transfers the optimum gradation voltage value data to the liquid crystal module 14. When the relationship is not optimum, that is, as shown in FIG. 10, with respect to the case wherein the brightness characteristic 13 has irregularities, the PC 17 resets a new gradation voltage value by transmitting data on a gradation voltage value which is changed so as to be slightly larger or smaller than the gradation voltage value set in the liquid crystal module 14, controls the reference signal generator 16, and causes the liquid crystal module 14 to display the half tone sequentially. The brightness photometer 15 then measures the brightness sequentially. Until the optimum gradation voltage value is obtained, this operation is repeated. When the PC 17 determines that the optimum gradation voltage value is obtained based on the measured data, the PC 17 transfers the optimum gradation voltage value data to the liquid crystal module 14 using the external control signal.

Figure 4:
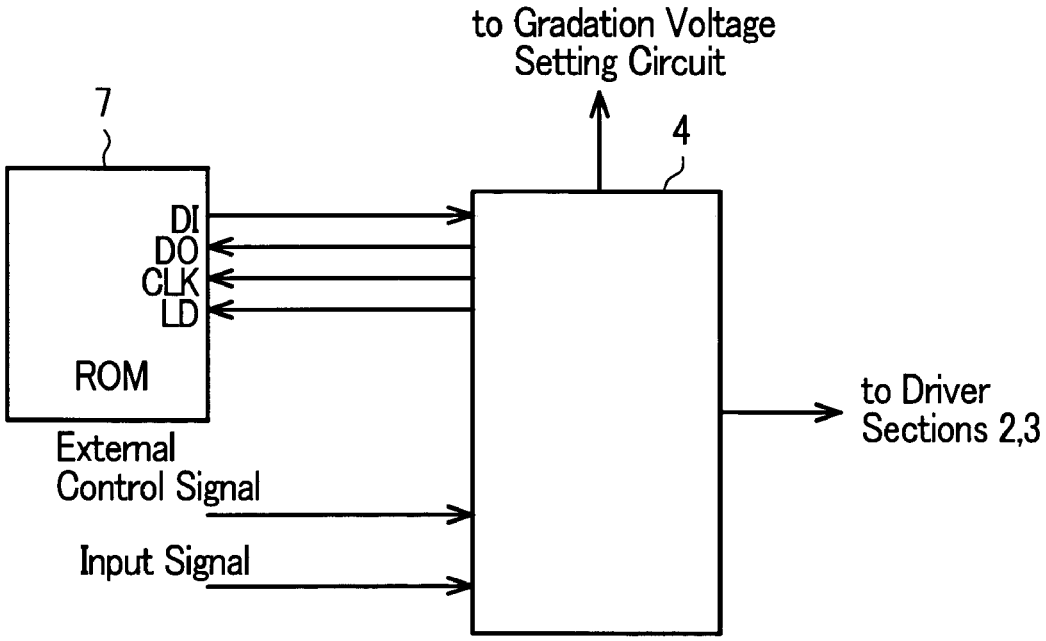
FIG. 4 is a block diagram showing a state in which the ROM 7 and the display control circuit 4 of FIG. 1 are connected with each other using a serial interface.

FIG. 4 is a view showing the writing of data to the ROM 7 based on the external control signals when the PC 17 determines that the relationship between the gradation and the brightness is optimum. As shown in FIG. 4, the external control signals are inputted to the display control circuit 4, the display control circuit 4 and the ROM 7 are connected with each other through a serial interface (DI, DO, CLK, LD) which performs reception and transmission of the gradation voltage value data, and the display control circuit 4 operate to write the gradation voltage value data in the ROM 7.

Figure 5:
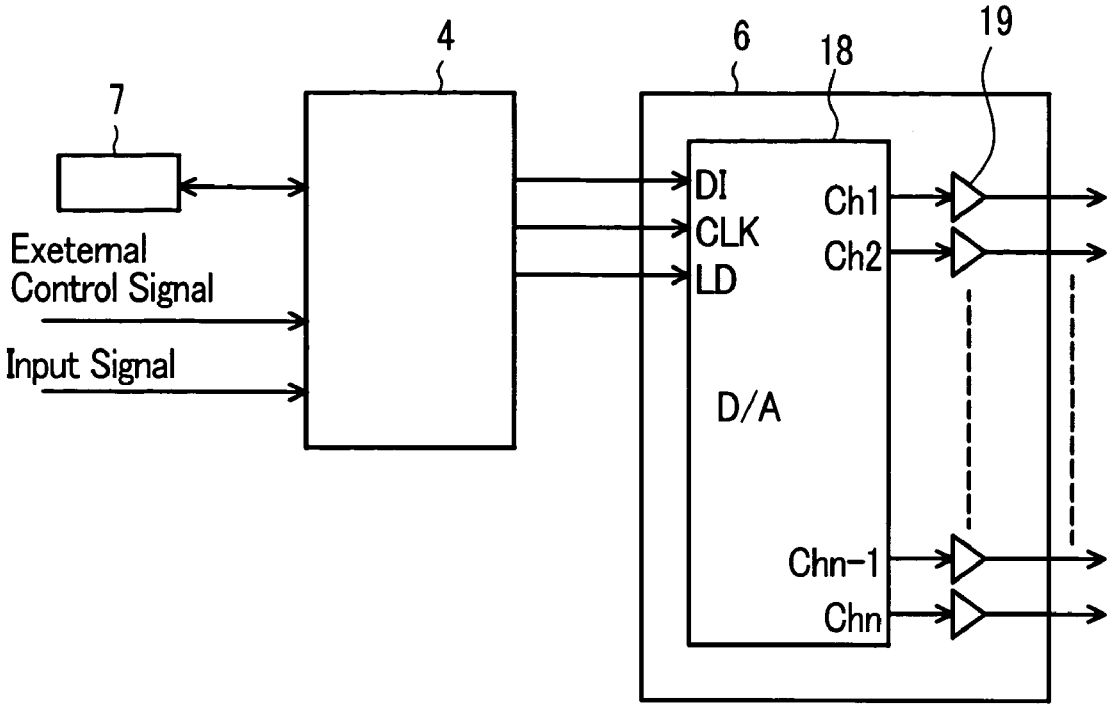
FIG. 5 is a schematic block diagram showing a state in which the display control circuit 4 and a D/A 18 of the gradation voltage setting circuit 6 of FIG. 1 are connected with each other using a serial interface.

FIG. 5 is a view showing the setting of gradation voltages to the gradation voltage setting circuit 6 based on the external control signals when the PC 17 determines that the relationship between the gradation and the brightness is not optimum. As seen in FIG. 15, the display control circuit 4 transmits the gradation voltage value data to the gradation voltage setting circuit 6 through a serial interface (DI, CLK, LD).

The gradation voltage setting circuit 6 uses a digital/analogue converter (hereinafter, referred to as "D/A") 18 to convert the digital gradation voltage value data consisting of black, white and a half tone into analogue data (Ch1 to Chn) respectively corresponding to the gradation voltage value data, while the analogue data is supplied to the source driver 3 as a newly set gradation voltage via an operational amplifier 19 and the like. The source driver 3 outputs the voltages corresponding to the input signal out of the newly set gradation voltages to the liquid crystal panel 1.

Assuming that the setting of the new gradation voltage value data formed of a half tone is repeated and it is determined that the PC 17 assumes the optimum gradation voltage value, the data on the optimum gradation voltage value is stored in the ROM 7.

Figure 6:
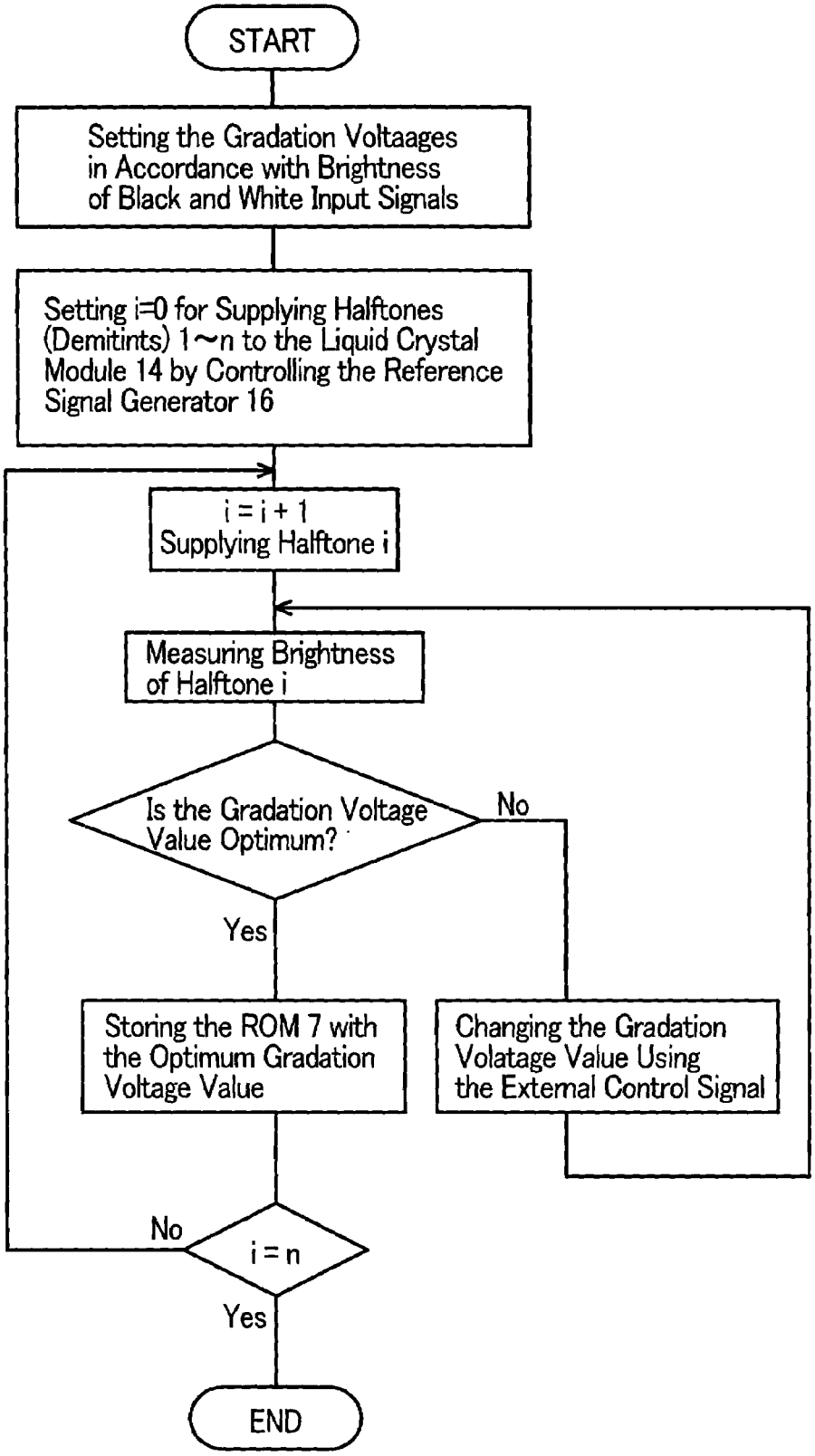
FIG. 6 is a flow chart showing a process for setting optimum gradation 15 voltages.

FIG. 6 is a flow chart of the process for setting the optimum gradation voltage which expresses the above-mentioned operations. Although the storing of the optimum gradation voltage values to the ROM 7 is performed one after another, the storing of the optimum gradation voltage values may be performed collectively in the final step.

With respect to the operation of the liquid crystal module 14 as a single unit which constitutes the liquid crystal display device, when power from the power source is supplied, the display control circuit 4 reads out the gradation voltage value data from the ROM 7 in response to a reset signal or the like, transmits the data to the gradation voltage setting circuit 6, and sets the gradation voltages corresponding to the data values. Accordingly, it is possible to produce a display having a fixed γ characteristic.

Further, when the gradation voltage value data is transmitted in response to an external control signal from an external CPU or the like, the display control circuit 4 transmits the data to the gradation voltage setting circuit 6 where the gradation voltage is set, whereby the gradation voltage can be set on a real-time basis. Accordingly, it is possible to set the gradation voltages which are most suitable for a change of scene, the bright portion and the dark portion of the transmitted image data, and, hence, images of high quality can be displayed.

Further, the brightness of the screen is dark when the backlight is turned on and becomes brighter along with the lapse of time. In such a case, however, by changing the gradation voltage along with the lapse of time in response to the external control signals, it is possible to always obtain an image display of high quality.

Figure 7:
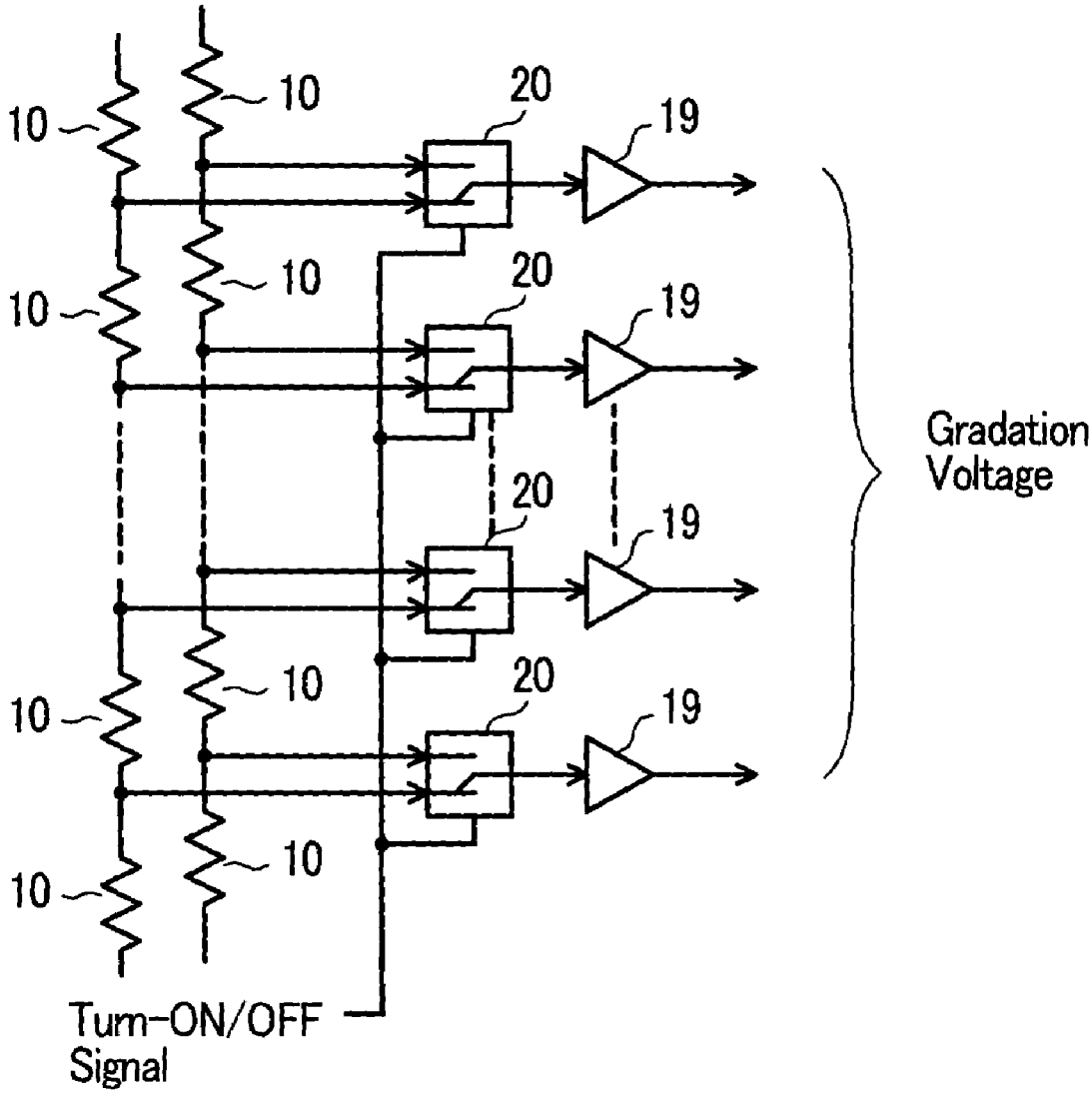
FIG. 7 is a circuit diagram of a circuit which replaces the gradation voltage setting circuit 6 in FIG. 5.

FIG. 7 shows one embodiment which further simplifies the gradation voltage generating means of the present invention, wherein the gradation voltage generating means is constituted of ladder resistors 10 and selectors 20 in place of the D/A 18 shown in FIG. 5. The gray scale voltages from the ROM 7, which become two kinds of references, are obtained by voltage dividing using the resistors 10. Either one of two kinds of voltages is selected by changeover in response to an ON/OFF signal using the selectors 20, and the selected voltage is supplied to the source driver 3 by way of the operational amplifier 19 or the like. Although this embodiment can select only two γ characteristics, this embodiment can change the γ characteristics using a small number of parts and at a low cost.

As has been explained heretofore, according to the present invention, it is possible to set the gradation voltages which respectively correspond to the manufactured panels. Accordingly, the irregularities of γ characteristics for every panel can be eliminated, and, hence, the irregularities of γ characteristics for every panel can be absorbed, whereby it is possible to provide a liquid crystal display device in which the yield rate of the manufacture of the panels is enhanced and, at the same time, which can display an optimum image.

Further, it is possible to set the gradation voltages corresponding to various images using external control signals, and, hence, it is possible to provide a liquid crystal display device which can favorably display an image of high quality by changing the γ characteristic depending on the scene produced on the screen.

Still further, by imparting a γ characteristic which increases the gradations to the panel, it is possible to provide a liquid crystal display device which exhibits fine images.

What is claimed is:

1. A liquid crystal display device:

storage means in which gradation voltage value data is stored; display control means in which gradation voltage value data read out from the storage means or gradation voltage value data based on external control signals is inputted; gradation voltage setting means which sets gradation voltages based on gradation voltage value data received from the display control means; driver means to which gradation voltages set by the gradation voltage setting means are inputted; and a liquid crystal panel which is driven in response to gradation voltages selected by the driver means, wherein writing of the gradation voltage value data to the storage means signals inputted to terminals of the display control means, such signals being inputted from outside the display control means; a brightness measuring unit which measures a brightness of the liquid crystal display device, and outputs a brightness data of the liquid crystal display device; and a personal computer which receives the brightness data from the brightness measuring unit; and wherein the personal computer determines whether the gradation voltage is within a predetermined range or not based on the brightness data, and generates the alternative gradation voltage value data, and outputs the alternative gradation voltage value data to the display control means when the gradation voltage is out of the predetermined range.

2. A liquid crystal display device comprising:

a storage unit configured to store initial gradation voltage value data;

a display control unit configured to read out the initial gradation voltage value data from the storage unit;

a gradation voltage setting unit configured to set gradation voltages based on the initial gradation voltage value data received from the display control unit;

a driver unit configured to drive gradation voltages based on the gradation voltages from the gradation voltage setting unit; and a liquid crystal panel configured to be driven in response to the gradation voltage from the driver unit, wherein the display control unit is adapted to receive alternative gradation voltage value data, such alternative gradation voltage value data being inputted from outside the display control unit, and wherein the gradation voltage setting unit is adapted to set gradation voltages based on the alternative gradation voltage value data, when the alternative gradation voltage value data is received in the display control unit.

3. A liquid crystal display device according to claim 2,wherein reading-out of the gradation voltage value data from the storage unit is automatically performed at a time of supplying a power source.

4. A liquid crystal display device according to claim 2, wherein receiving of the alternative gradation voltage value data, is performed during a normal operation.

5. A liquid crystal display device according to claim 2, comprising:

a brightness measuring unit which measures a brightness of the liquid crystal display device, and outputs a brightness data of the liquid crystal display device; and a personal computer which receives the brightness data from the brightness measuring unit, generates the alternative gradation voltage value data, and outputs the alternative gradation voltage value data to the display control unit.

6. A liquid crystal display device according to claim 2, comprising:

a brightness measuring unit which measures a brightness of the liquid crystal display device, and outputs a brightness data of the liquid crystal display device; and a personal computer which receives the brightness data from the brightness measuring unit; and wherein the personal computer determines whether the gradation voltage is within a predetermined range or not based on the brightness data, and generates the alternative gradation voltage value data, and outputs the alternative gradation voltage value data to the display control unit when the gradation voltage is out of the predetermined range.

* * * * *